United States Patent [19]

Nanjyo et al.

[11] 4,122,295

[45] Oct. 24, 1978

[54] FURNACE WALL STRUCTURE CAPABLE OF TOLERATING HIGH HEAT LOAD FOR USE IN ELECTRIC ARC FURNACE

[75] Inventors: Toshio Nanjyo, Yokohama; Akinori Nakamura, Kamakura, both of Japan

[73] Assignee: Ishikawajima-Harima Jukogyo Kabushiki Kaisha, Ote, Japan

[21] Appl. No.: 756,710

[22] Filed: Jan. 4, 1977

[30] Foreign Application Priority Data

Jan. 17, 1976 [JP] Japan ..... 51/4529
Nov. 11, 1976 [JP] Japan ..... 51/151316[U]

[51] Int. Cl.[2] ..... F27D 1/12
[52] U.S. Cl. ..... 13/32
[58] Field of Search ..... 13/32, 35; 165/168, 165/169; 266/280, 283, 286

[56] References Cited

U.S. PATENT DOCUMENTS

| | | | |
|---|---|---|---|
| 3,619,467 | 11/1971 | Goodman | 13/35 |
| 3,843,106 | 10/1974 | Nanjyo et al. | 13/32 X |
| 3,849,587 | 11/1974 | Hatch et al. | 13/32 |

*Primary Examiner*—R. N. Envall, Jr.
*Attorney, Agent, or Firm*—Scrivener, Parker, Scrivener & Clarke

[57] ABSTRACT

Disclosed is a furnace wall structure which is placed in opposed relation with electrodes of a electric arc furnace and is made of copper or copper alloy in order to ensure a long service life, improved safety and a minimum thermal loss and in which a front plate which defines a heat-receiving surface exposed within the furnace is cooled by the forced circulation of cooling water.

10 Claims, 12 Drawing Figures

FURNACE WALL STRUCTURE CAPABLE OF TOLERATING HIGH HEAT LOAD FOR USE IN ELECTRIC ARC FURNACE

DETAILED DESCRIPTION OF THE INVENTION

The present invention relates to furnace wall structures which may be used as wall components of a furnace shell of an ultra-high-power (UHP), super-ultra-high-power (SUHP) are furnace or an arc furnace of the type wherein finely divided materials such as sponge iron are continuously charged and which may be placed in opposed relation with electrodes or at any other places subjected to high heat loads.

Water-jackets and cast blocks including water cooling pipes which are by far superior than water-jacket have long been used as furnace wall components placed at the so-called hot spots in opposed relation with electrodes. Meanwhile, in order to attain high productivity, electric power of arc furnace has been increased so that heat loads to the furnace wall have been increased accordingly. Furthermore, with the increase use of arc furnaces of the type wherein finely divided materials such as sponge iron are continuously charged, the furnace walls are subjected to high heat loads for an increased time.

As a result, with the prior art water jackets, a danger of explosion due to water leakage is increased. The cast blocks with an indirect cooling construction cannot be used with heat load in excess of a certain level. More specifically, when firebricks are used to construct a furnace wall which is in opposed relation with an electrode and receives high heat load, the increase in electric power imposes a limit to the improvement of a service life of the firebricks only by the improvement of qualities thereof. To overcome this problem, steel water-jackets have come to be used instead of the firebricks. They are placed between the firebricks and steel shells so as to increase the service life of the former, but there exists a gap between the firebricks and the water-jacket so that the effective cooling of the firebricks cannot be attained. As a result, they are easily consumed so that the water-jacket is exposed directly to the heat inside the furnace. Therefore the prior art water-jackets have come to be designed in such a way that their heat-receiving surfaces may be directly exposed inside the furnace.

The prior art water-jackets are assembled from steel plates by welding, and because of their construction the flow rate of cooling water is limited to the order of 0.01 to 0.5 m (meter)/s (second). The water-jackets with a flow rate exceeding 1 m/s have not been available. In general, a steel plate has a thermal conductivity $\lambda = 40$ Kcal/m h ° C (Kilocaloric/meter.hour.degree) and its thickness is limited to 10 to 25 mm due to the construction of water-jackets. (A minimum thickness is dependent upon the pressure of cooling water whereas a maximum thickness is dependent upon the temperature difference between the heat-receiving and cooling surfaces thereof.) As a result, a thermal resistance which is defined as $l/\lambda$ ranges from (2.5 to 6.0) $\times$ ($0^{-4}$ m.h. ° C/Kcal (square meter.hour.degree/kilocaloric) so that with the decrease in heat load the heat-receiving surface may not be satisfactorily cooled. That is, the prior art steel water-jackets cannot withstand high heat loads. In addition, the steel water-jackets have the following problems:

(a) Variation in heat load results in the variation in temperature of steel plates of the water-jacket so that cracks may occur along welded lines.

(b) Because of a small heat capacity and a small heat conductivity, sparks tend to cause the leakage of cooling water from the water-jacket.

(c) The water-jackets are easily adversely affected by the fuel and oxygen burners.

(d) They are also easily adversely affected by the misblowing of oxygen.

(e) They are also easily adversely affected by the contact with slag and (f) With the little amount of molten steel. The adverse effects (c), (d), (e) and (f) result in the leakage of cooling water and burnout. In addition, no one can predict when and where such leakage and burnout occur so that the safe operation is adversely affected. In the prior art water-jackets, slag receiving shelves or the like are formed on the heat-receiving surface so that the adhesion to and accumulation on the heat-receiving surface of slag and the like may be facilitated and their falling-off may be prevented, whereby the thermal loss may be minimized and the safety in operation may be assured. However, the problems described above have not been essentially solved yet.

In the cast blocks, cooling water tubes or pipes are casted in the block so that a heat capacity may be increased and consequently the accidents encountered in the prior art water-jackets may be prevented. However, the cast blocks have a thermal resistance considerably higher than the water-jackets so that more-soft-cooling results. As a result, they are consumed at higher rates under high heat loads.

Because of the fundamental safety problems of the prior art furnace wall structures, when they are used in the SUHP arc furnaces and arc furnaces of the type wherein sponge iron is continuously charged, they cannot satisfy the conditions required for the furnace walls under high heat loads; that is, (1) safety, (2) long service life and (3) decrease in thermal loss, alone or in combination of (1) + (2) as well as (1) + (2) + (3).

Therefore there has long been a demand for the furnace wall structures for use in the SUHP arc furnaces and arc furnaces of the type wherein the main charge mainly consisting of sponge iron is continuously loaded, the furnace wall structures being satisfactorily withstanding not only the high heat loads due to the thermal radiation from strong arc plasma and the thermal convection from the arc flares but also the adverse thermal effects due to the above-mentioned causes; that is, due to auxiliary burners, the misblowing of oxygen by carelessness of operators to the furnace walls, the sparks caused by arcs, the reladle, the contact with slags and a small quantity of molten steel. In short, there has long been a strong demand for the furnace wall structures whose long service life and safety under any adverse thermal effects due to the increase in heat load may be satisfactorily assured. To satisfy the above-mentioned conditions, those skilled in the art have been so far considered that cooling effects on the furnace wall structures must be considerably increased and the resultant increase in thermal loss is unavoidable.

In view of the above, one of the objects of the present invention is to provide a safe furnace wall structure having a longer service life.

Another object of the present invention is to provide a furnace wall structure with a minimum thermal loss.

The above and other objects, features and advantages of the present invention will become more apparent from the following description of preferred embodiments thereof taken in conjunction with the accompanying drawings, in which.

Figure 1:
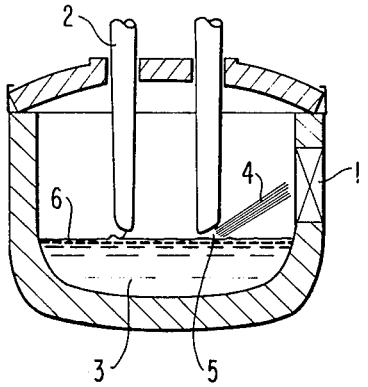
FIG. 1 is a sectional view of an arc furnace in the flat bath period.

Same reference numerals are used to designate similar parts in FIGS. 7 through 12.

To attain the present invention, the inventors made extensive studies and experiments on the furnace structures, the results of which will be described prior to the description of the preferred embodiments of the present invention.

It is when the furnace wall is directly exposed to the heat source that it is subjected to a large quantity of heat loads which may be classified, in general, as follows:

(1) the thermal radiation from molten steel (including slags), the furnace walls and other walls after the melt-down stage and when the electric supply is suspended, (2) the heat load from hot spots after the melt-down stage and when the electric current is being supply; that is, the sum of the heat load (1), radiation mainly from the arc plasmas and convection mainly due to arc flares, (3) the heat loads which are increased due to the oxygen blowing and may be divided into (3 — 1) the heat load due to the cutting of scraps by oxygen, and (3 — 2) the heat load due to the oxygen refining of molten steel, (4) the heat load from fuel and oxygen burners, (5) the heat load due to the oxethermic reaction produced when the additional or auxiliary charging (CaO and so on) is made, (6) the heat load due to the sparks between the scraps and the electrodes, (7) the load due to the radiation and depositions of splashes during re-ladle stage, (8) the heat load due to the direct contact with the slag, and (9) the heat load due to the direct contact with molten steel.

In the experiments conducted by the inventors, the said furnace wall structure was made of a well known material such as copper having an excellent thermal conductivity and were disposed to cool hot spots on the walls of an arc furnace, and temperature measurements were made at least two points along the flow of heat between the heat receiving surface and the heat dissipating or cooling surface to determine a temperature gradient $\Delta T$ so that the heat flux defined as $q$ = (Kcal/m$^2$h) of each load may be obtained by the following relation:

$$q = \Delta T/(l/\lambda)$$

where $l$ = a distance between the two measuring points, and $\lambda$ = a thermal conductivity of a metal plate placed between the heat receiving surface and the cooling surface for permitting the above-mentioned temperature measurements.

The experiments were conducted under the condition that nothing was deposited on the heat receiving surface.

Figure 2:
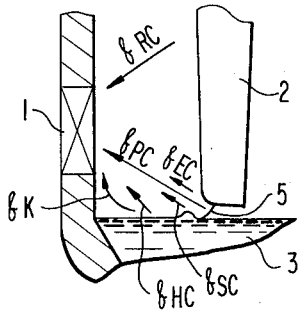
FIG. 2 is a schematic view illustrating the thermal transmission to a hot spot.

From the experiments maximum heat loads exerted to the walls of various arc furnaces were determined, and it was found that the prior art water-jackets have some problems, which may be solved by the hard cooling as will be described in detail below 1. Heat loads described in (1) and (2) above:

The operating conditions in the furnace are as shown in FIG. 1 during the flat bath period. In FIG. 1, reference numeral 1 denotes a hot spot; 2, electrodes; 3, molten steel; 4, arc flares; 5, arc plasma; and 6, slag. The thermal conduction through the hot spot 1 under the normal conditions is effected as shown in FIG. 2. The heat flux $q_T$ or heat load per unit area of the hot spot 1 is given by $$q_T = q_{PC} + q_K + q_{HC} + q_{EC} + q_{SC} + q_{RC}$$
$$(\text{Kcal/m}^2.\text{h})$$

where $q_{PC}$ = heat flux from the arc plasma 5, $q_K$ = heat flux due to the convection from the arc flare 4, $q_{HC}$ = heat flux due to the radiation from the molten steel 3, $q_{EC}$ = heat flux due to the radiation from the arc spot on the electrode 2, $q_{SC}$ = heat flux due to the radiation from the arc spot in the molten steel 3, and $q_{RC}$ = heat flux due to the radiation from the surrounding linings.

These fluxes vary over a wide range depending upon the operating conditions such as the profile and construction of the furnace, rating of equipments used such as the capacity of a transformer used, power supply, operation power factor, the thickness of slag and so on.

As the measure of the head load exerted to the hot spot on the wall of the furnace, the effective refractory erosion index defined as $$R_{EP} = \frac{Pp \cdot Vp}{L^2}\left(\frac{MW \cdot V}{m^2}\right)$$

is generally used, where $p_P$ = arc plasma power (MW), $V_P$ = voltage drop (V) of arc plasma, and L = minimum distance ($m$) from the side surface of the electrode to the wall of the furnace.

Figure 3:
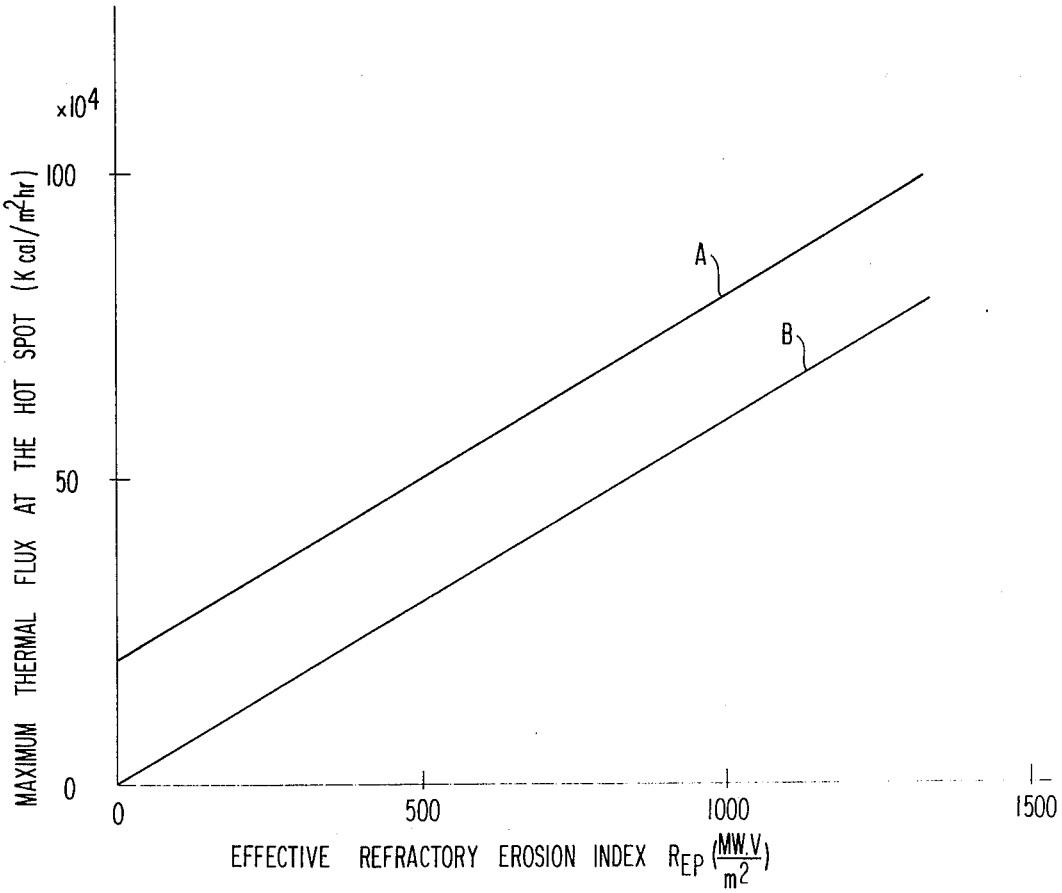
FIG. 3 is a graph illustrating the relationship between the maximum thermal flux and the effective refractory erosion index at the hot spot.

In order to determine the relationship between $R_{EP}$ and the heat flux $q_T$ at the spot on the wall of the furnace, the temperature-gradient-measuring water-jackets of the type described were embedded in the walls of various arc furnaces and the measurements were made under the condition that the heating surface of the jacket was covered with nothing. The results are shown in FIG. 3, wherein the characteristic curve A indicates the maximum thermal flux at the hot spot whereas the curve B, the heat flux at the hot spot due to $q_{PC} + q_K + q_{HC} + q_{EC}$. In case of quick melting, $R_{EP}$ is inevitably increased and has been limited to a value not exceeding $R_{EP} = 500$ (MW·V/m²) in the conventional arc furnaces in order to protect the walls. However, according to the present invention the upper limit is set to $R_{EP} = 1{,}300$ (MW·V/m²) under the assumptions that in the future medium- and large-sized SUHP arc furnaces, a maximum allowable transformer capacity be 10,000 $k$·VA·/$t$ (ton)(for instance, for a 100 -ton arc furnace, a transformer capacity is 100 MVA) and that the high-power operation (long-arc operation) be effected at a power factor of the order of 88% which is the upper practical safety limit in the arc furnace and which causes the most adverse heat load to be exerted on the hot spot. The inventors found out that this upper limit of $R_{EP}$ is sufficient even with a future SUHP arc furnace and even if the operation mistakes should happen. From FIG. 3 it is seen that the upper limit of the thermal flux at the hot spot does not exceed one million Kcal/m²·h even when the hot spot is not deposited with slag and so on. From the experimental results, the inventors found out that the heat flux when electric current flows is between (50 and 150) $\times 10^3$ Kcal/m² h and does not exceed $200 \times 10^3$ KCM/m² h.

Next the temperature gradient $\Delta T$ was measured from the relation described below under the conditions that the upper limit of heat flux be $1 \times 10^6$ Kcal/m²·h and that an allowable limit of thermal stress caused by the temperature difference between the inner and outer surfaces of a steel plate (a steel disk whose periphery being securely held or tied stationary) of a steel water jacket be 4500 Kg/cm². The relation is $$\sigma = \frac{0.5\alpha \cdot E \cdot \Delta T}{1 - \gamma}$$

where $\alpha$ = coefficient of thermal expansion,

E = Young's modulus, and

Y = Poisson's ratio.

Then $$\Delta Tst = \frac{4500(1 - 0.3)}{0.5 \times 1.2 \times 10^{-5} \times 2.1 \times 10^6} = 250^\circ \text{ C}$$

With a thermal conductivity = 40 Kcal/m·h·° C, an allowable thickness $l_{st}$ is given by $$l_{st} = \frac{\lambda \cdot \Delta T}{q} = \frac{40 \times 250}{100 \times 10^4} = 0.01m = 10\text{mm}$$

When the water-jacket is made of copper plates, $$\Delta Tcu = \frac{2100(1 - 0.34)}{0.5 \times 1.68 \times 10^{-5} \times 1.25 \times 10^6} = 132^\circ \text{ C}$$

With a thermal conductivity $\lambda = 300$ Kcal/m·h·° C. of copper plate, an allowable thickness $l$ cu is given by $$lcu = \frac{300 \times 132}{100 \times 10^4} = 0.0396m \approx 40\text{mm}$$

It is seen that when the copper plates are used, the allowable thickness is four times as thick as the allowable thickness of steel plates. This suggests that a heat capacity may be also increased four times as much as when steel plates are used. The steel water-jackets are subjected to crackings along the welded lines due to the high heat load, but this phenomenon is not observed with the said furnace wall structure. Thus it is apparent that the said furnace wall structure is by far superior to the steel water-jackets.

2. Heat loads defined in (3) and (5):

The excessive increase in heat load (3 — 1) to the walls of the furnace due to the cutting of scraps with oxygen is caused by carelessness on the part of the operators, but cannot be completely eliminated and rather can happen very frequently. It is difficult to quantitatively define the above excessive increase in heat load due to carelessness. According to the experiments, because of its nature the heat load (3 — 1) does not overlap with the maximum heat load due to the arcs and does not exceed $1 \times 10^6$ Kcal/m²·h even at a local spot.

Experiences show that holes are formed in the steel water-jackets because of the slow diffusion of heat and rapid oxidation due to the misblow of oxygen, but this accident may be completely prevented in case of the said furnace wall structure.

As with the auxiliary material charging (See (5) above) which results in the exothemic reaction, oxygen blowing (3 — 2) results, in the exothermic reaction which in turn results the rapid increase in temperature of molten steel, slag and gas in the furnace. However the walls are not subjected to locally high heat loads. According to the experiments, the heat load (3 — 2) will not exceed $500 \times 10^3$ Kcal/m²·h.

Thus it is seen that the problems encountered when the prior art steel water-jackets may be substantially overcomed by the use of the said furnace wall structure.

3. Heat load (4):

In general, the fuel and oxygen burners flame are not directed toward walls, but it frequently happens that the high-temperature combustion gases from the burners flow through the space between the walls and scraps when pressed or large scraps are charged just in front of the burners so that the walls are subjected to excessive heat loads. However, the heat load (4) is completely independent of the heat load from the arcs, and according to the experiments the thermal flux will not exceed $500 \times 10^3$ Kcal/m² h.

4. Heat load (6):

Experiences show that sparks with a large electric current tend to occur when an electrode is broken and made into contact with the wall or between the remaining scrap and the water-jacket, causing the water leakage of the steel water-jackets. However, the said furnace wall structure has a high electrical conductivity and a high thermal conductivity so that the rapid diffusion of electric current and heat can be made through the said furnace wall structure properly, and consequently the safe operation may be assured.

5. Heat load (7):

The heat load (7) to the walls due to the radiation when the molten steel is returned to the furnace, does not produce simultaneously with the heat loads from the arcs and the radiation from the walls so that the heat load (7) is almost equal to the heat load (1) and will not exceed $200 \times 10^3$ Kcal/m$^2$ h in practice, which was confirmed from the experiments. However, due to the depositions of molten steel splashed, the walls are locally subjected to the high heat loads, but it can not be considered that a large quantity of molten steel is continuously kept in contact with one spot of the said furnace wall structure. In this case, the said furnace wall structure is more advantageous in view of low thermal resistance, high cooling efficiency and high heat capacity.

Figure 4:
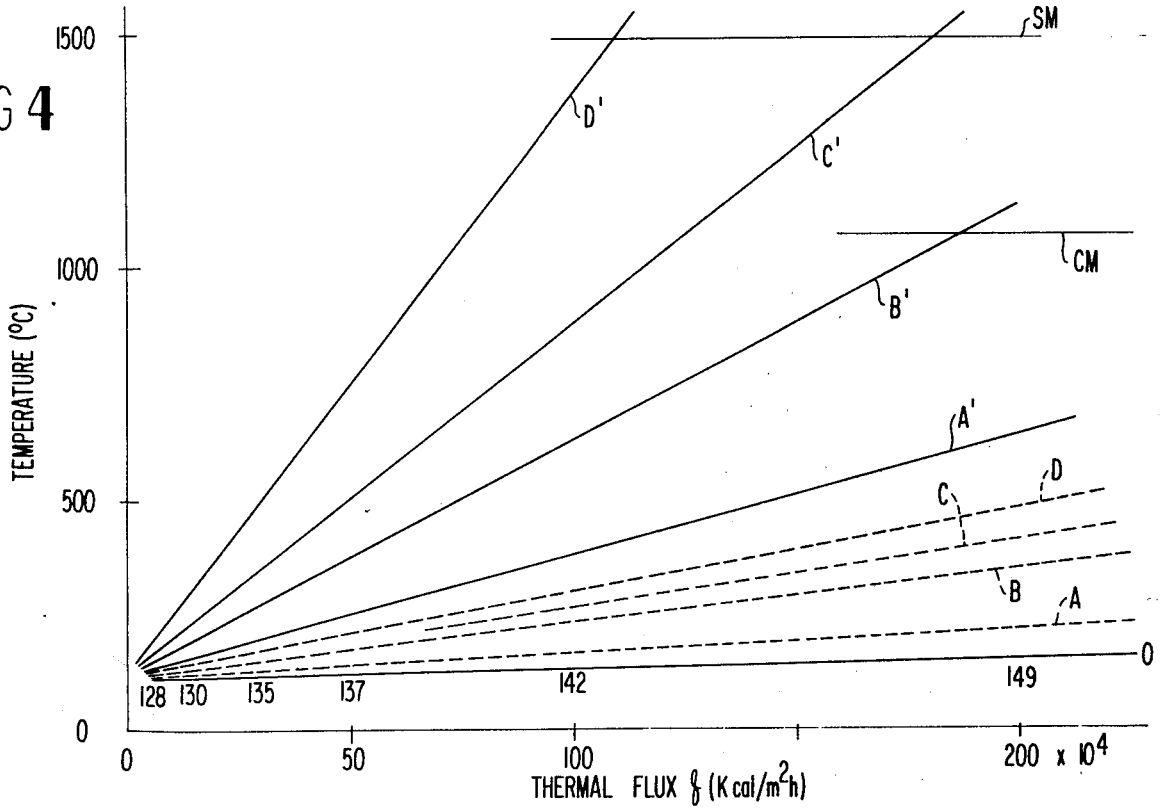
FIG. 4 is a graph illustrating the relationship between the temperature and thermal flux in various water-jackets.

6. Heat load (8):

The direct contact of the slag with the water-jackets occurs very often as the water-jackets are set up at lower positions adjacent to the molten steel surface in order to increase the service life of refractories adjacent to the slag line. Especially the use of sponge iron results in increase in quantity of slag and enhanced bubbling so that the chance of direct contact is extremely high. Meanwhile, because of insufficient cooling capacity of the prior art water-jackets they are so arranged as to avoid the direct contact with the slag as less as possible. The heat fluxes due to the contact with the slag vary over a wide range depending upon the temperature, qualities and movement of slag, and are in general (600 to 1,000) $\times 10^3$ Kcal/m$^2$·h and will not exceed 2,000 $\times 10^3$ Kcal/m$^2$·h even when iron oxides are large in quantity or when the slag with molten steel moves and is made in continuous contact with the water-jackets. As shown in FIG. 4, with the said furnace wall structure with a thickness of 40mm, the surface temperature is maintained less than 400° C. This means that the use of the said furnace wall structure ensures a higher degree of safety as compared with the prior art steel water-jackets. In FIG. 4, the characteristic curves A, B, C and D indicate the temperature of the heating surface; that is, the surface temperatures of the said furnace wall structure 10mm, 30mm, 40mm and 50mm, respectively, in thickness. The characteristic curves A', B', C' and D' indicate those of the steel water-jackets 10mm, 20mm, 30mm and 50mm, respectively in thickness. Melting points of copper and steel are indicated by CM and SM, respectively.

7. Load heat (9):

In case of the said furnace wall structure, the direct contact with molten steel will not cause the excessive thermal fluxes if cooling water is flowing at sufficiently high flow rates regardless of the quantity of molten steel made into contact with the water-jackets. However, in an extreme case which hardly occurs, molten steel is caused to be made into continuous contact with the same surface of the water-jacket so that the cooling water changes from nuclerate boiling to film boiling with the resultant temperature increase of the surface to a burnout temperature. In the electric furnaces, the direct and continuous contact of molten steel with the walls may avoided under the normal operations, but in order to ensure the safety, the direct and continuous contact must be taken into consideration and consequently a high value of burnout thermal flux $q_{BO}$ must be used in design.

Figure 5:
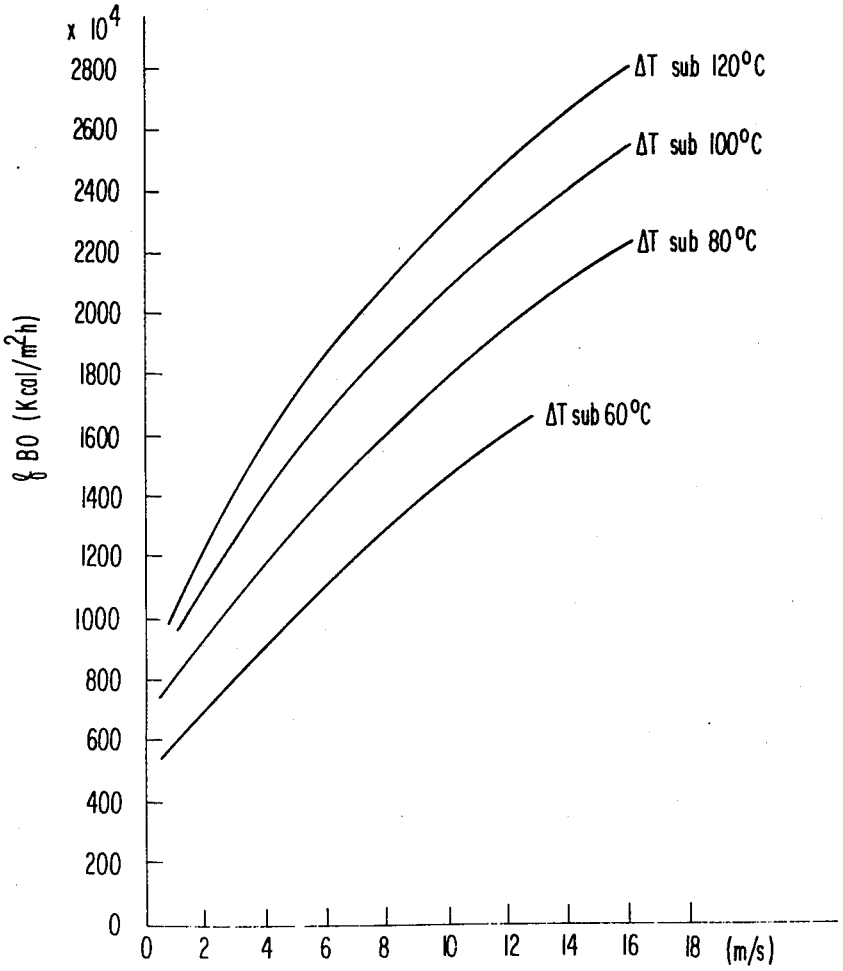
FIG. 5 is a graph illustrating the relationship between the burnout thermal flux and the flow rate of cooling water with the sub-cool temperature as a parameter.

The burnout thermal flux which may be obtained by the dropping tests of molten steel varies over a wide range depending upon a sub-cool temperature $\Delta T$ sub and a flow rate $v$ of cooling water as shown in FIG. 5 wherein the experimental data which were obtained with the use of the said furnace wall structure 20mm in thickness are plotted with the sub-cool temperature $\Delta T$ sub as parameters. With the prior art water jackets, $q_{BO}$ was (4 to 8) $\times 10^6$ Kcal/m$^2$·h, because the flow rate $v$ is less than 1 m/s, but it may be increased to $12 \times 10^6$ Kcal/m$^2$·h when the flow rate may be increased in excess of 4 m/s so that the safety may be considerably increased, which was confirmed by the actual furnace tests conducted by the inventors. It was also found out that when the flow rate is in excess of 4 m/s the deposition on the cooling surfaces may be minimized.

Figure 6:
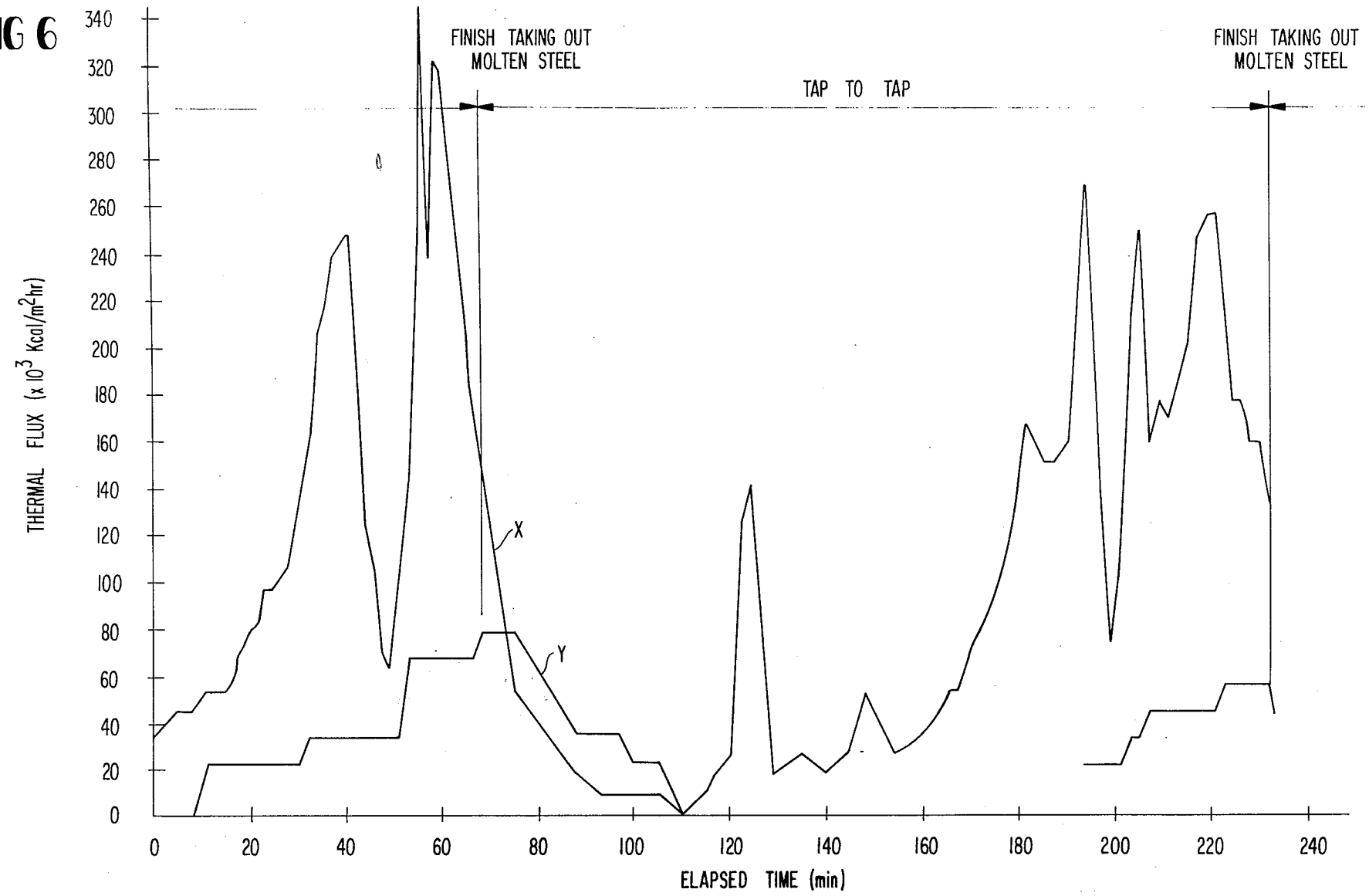
FIG. 6 is a graph illustrating the variation in thermal flux at the hot spot during the furnace operation.

So far the experimental data or results have been described under the assumption that the heat receiving surfaces of the water jackets are completely exposed within the furnace. In practice, however, if the heat receiving surface is sufficiently cooled with cooling water, the thermal balance is attained when slag is deposited on the heat-receiving surface in such a thickness that the temperature at the surface of the slag deposited is equal to a melting point of the slag. Under this condition, the heat flux is balanced at the order of (30 to 80) $\times$ 103Kcal/m$^2$·h. As an example, shown in FIG. 6 are Kcal fluxes at hot spots of a 60-ton arc furnace during operation. The characteristic curve X indicates when the prior art water-jackets were used, whereas the curve Y, when the furnace wall structure in accordance with the present invention were used.

Figure 7:
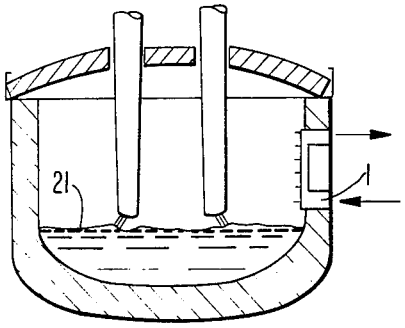
FIG. 7 is a schematic sectional view of an arc furnace to which is applied the present invention.
Figure 8:
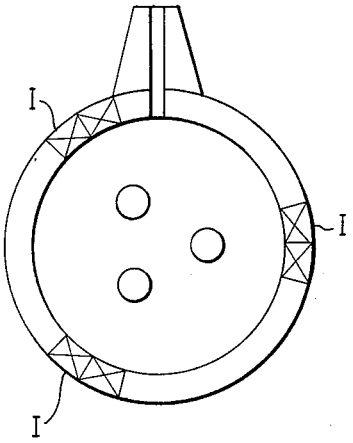
FIG. 8 is a cross sectional view thereof.

The furnace wall structures for high heat load in accord with the present invention are based upon the above experimental results, and one preferred embodiment thereof will be described in detail with particular reference to FIGS. 7, 8 and 9.

Figure 9:
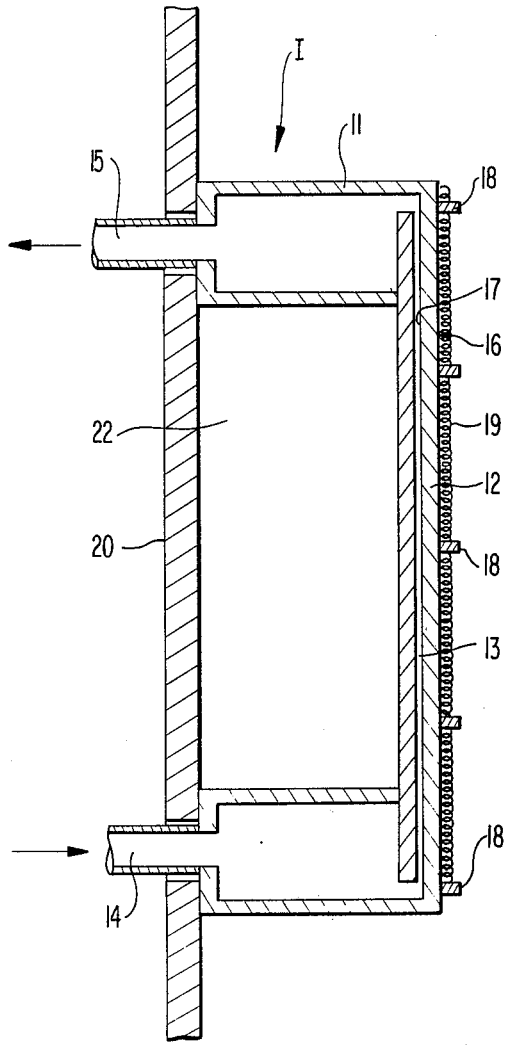
FIG. 9 is a sectional view, on enlarged scale, of a preferred embodiment of a furnace wall structure incorporated in the arc furnace shown in FIGS. 7 and 8.

As best shown in FIG. 9, a furnace wall structure I in accordance with the present invention has a main body 11 with a front plate 12 and a cooling water passage 13. The front plate 12 is made of copper or copper alloy with the thermal resistance $l/\lambda = 0.5$ to $1.5 \times 10^{-4}$ m$^2$·h·° C./Kcal, the thermal conductivity $\lambda$ Kcal/m·h ° C. and the thickness in $m$, and the rear surface of the front plate 12 is sufficiently smoothed so that the deposition from cooling water may be prevented and the cooling water may flow at a higher flow rate through the cooling water passage 13. The furnace wall structure I is further provided with a cooling water inlet 14 and a cooling water outlet 15. The front surface of the front plate 12 is used as a heat receiving surface 16 while the rear surface, as a cooling surface 17, and the heat receiving surface 16 is provided with a slag receiving shelves 18 which may prevent the falling off of layers 19 of slags and the like deposited and cooled on the heat-receiving surface 16 due to the mechanical external forces exerted to the layers as when a charge is loaded. Cooling water is forced into the cooling water passage 13 through the inlet 14 for cooling the cooling surface 17 of the front plate 12 and is discharged through the outlet 15. The furnace wall structure I with the above construction is set up mainly at a hot spot of the walls of a furnace. That is, the structure I is mounted on a furnace shell plate 20 in such a way that the lower end may be located adjacent to the slag line 21 and the heat-receiving surface 16 of the front plate 12 may be directed toward the center of the furnace as best shown in FIGS. 7 and 8, and refractories 22 are filled between the shell plate 20 and the furnace wall structure I. In this embodiments, the cooling water passage 13 is defined by copper plates which are joined together by electron beam welding in order to improve the dimensional accuracies.

In operation, cooling water is circulated at a flow rate higher than 4.0 m/s. Since the cooling water passage 13 is defined by the smooth surfaces and the cooling water is circulated at a high flow rate, the deposition from cooling water on the cooling surface 17 may be prevented. During the operation, the slag and the like are deposited and solidified upon the heat-receiving surface 16, but they may be sufficiently cooled because the cooling water is circulated at high speeds. As described above, the front plate 12 is made of copper or copper alloy and has a sufficient thickness within the limit that the thermal resistance is (0.5 to 1.5) $\times 10^{-4}$ m²·h·° C./Kcal, so that it may have a sufficient heat capacity to encounter the heat load due to the contact with the slag and or molten steel and to the sparks. In addition, the front plate 12 may sufficiently withstand the pressure exerted from the cooling water and the water leakage problem may be eliminated.

The reason why the thermal resistance $l/\lambda$ must be within the range from (0.5 to 1.5) $\times 10^{-4}$ m²·h·°C./Kcal will be described below.

The lower limit = $0.5 \times 10^{-4}$ (m²·h· ° C./kcal):

In order to withstand the pressure exerted from the cooling water and the impact of the charged material such as scraps and to provide a sufficient heat capacity to encounter the heat load due to the contact with molten steel and sparks, the minimum allowable thickness is determined as 15mm. From this thickness and the thermal conductivity $\lambda$ = 260 to 300 (kcal/m·h·° C.), $l/\lambda = 0.015/300 = 0.5 \times 10^{-4}$ (m²·h·° C./kcal) is determined.

The upper limit = $1.5 \times 10^{-4}$ (m²·h·° C./kcal):

As stated hereinbefore, under the conditions that the upper limit of heat flux be $1 \times 10^6$ kcal/m²·h an allowable thickness of copper plate is 40mm which is determined by the upper limit of heat stress produced due to the temperature difference between the front and rear surfaces of the copper plate. From this thickness and the thermal conductivity $\lambda$ = 260 to 300 (kcal/m·h·° C.), $l/\lambda = 0.04/260 \approx 1.5 \times 10^{-4}$ (m²·h·° C./kcal) is determined. In the case of the contact with the molten steel, under the conditions that upper limit of heat flux be $q = 5 \times 10^6$ (kcal/m²·h), the temperature difference between the front and rear surfaces is $\Delta t = 5 \times 10^6 \times 1.5 \times 10^{-4} = 750°$ C. The temperature of the rear or cooling surface is $$t_c = t_s + \Delta t \text{ sat}$$

where $t_s$ = a saturation temperature of cooling water, and $\Delta t_{sat}$ = degree of superheat on the cooling surface.

With the pressure of cooling water P = 2 kg/cm², $t_s \approx$ 120° C.

$$\Delta t_{sat} = q^{0.33}/C_1 \times P^{0.4} \text{ (Nishikawa's equation)}$$
$$= (5 \times 10^6)^{0.33}/(3.16 \times 2^{0.4}) = 39° \text{ C.}$$

Therefore, $$t_c = 120 + 39 = 159° \text{ C.}$$

Then, the temperature of the front or heat-receiving surface is $t_h = 159 + 750 = 909°$ C.

This temperature is lower than the melting point 1080° C. of native copper, and therefore the meltdown of the main body will not occur.

Figure 10:
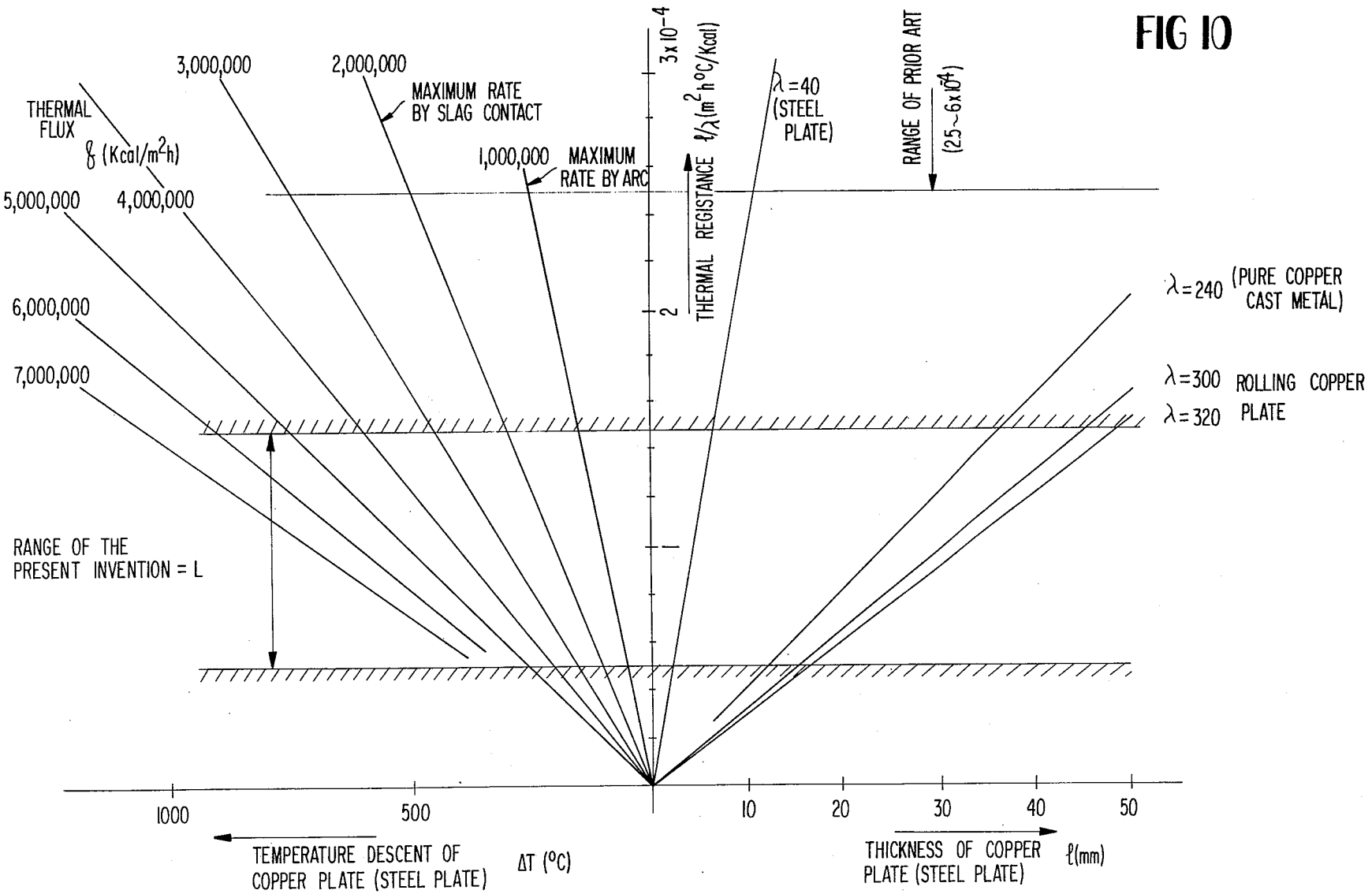
FIG. 10 shows the relations between the range of thermal resistance of the present invention and one of the prior art.

FIG. 10 shows the relationship between the thermal resistance which is dependent upon both the thickness $l$ and thermal conductivity $\lambda$ of the front plate 12 and the temperature drop across the front plate 12 which is dependent upon the thermal resistance and heat flux $q$. In other words, FIG. 10 shows the heat transmission characteristics of the furnace wall structures in accordance with the present invention. In FIG. 10, the present invention uses the thermal resistance within a hatched area L. The corresponding range of the prior art steel water jackets is indicated by L' and is from (2.5 to 6.0) $\times 10^{-4}$ m²·h·° C./Kcal, which is by far greater than the range of the present invention.

Figure 11:
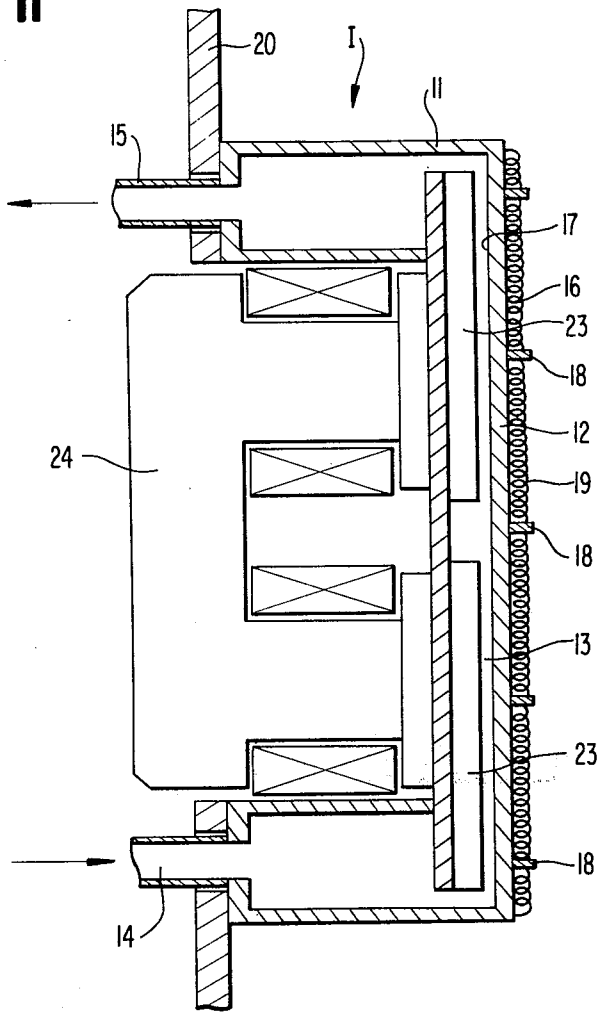
FIG. 11 is a sectional view of another preferred embodiment of the present invention.

In FIG. 11 there is shown another preferred embodiment of a furnace wall structure in accordance with the present invention which is substantially similar in construction to that shown in FIG. 9 except that pole pieces 23 and an electromagnet 24 are provided. More specifically, the pole pieces 23 each made of a suitable magnetic material and having a sufficiently large area are disposed within the cooling water passage 13, so that the gap between the electromagnet 24 and the iron material or the iron-containing slag attracted on the front surface of the front plate 12 may be compensated to decrease the magnetic resistance and thus obtain stronger magnetic force and the electromagnet 24 is disposed on the rear surface of a plate which defines together with the front plate 12 the cooling water passage 13 so that the iron-containing slag and steel may be easily trapped on the heat-receiving surface 16 of the front plate 12.

Because of the pole pieces 23, and the electromagnet 24 the slag and main charges are more densely and strongly accumulated over the heat-receiving surface 16 of the front plate 12 so that as compared with the embodiment shown in FIG. 9, the slag and the like may be deposited in greater thickness. In addition, the thermal efficiency may be increased and the more positive protection of the walls of the furnace may be ensured when the furnace wall structures of the type shown in FIG. 11 are used in an arc furnace of the type wherein iron-containing metal particles such as reducing iron particles are continuously charged.

Figure 12:
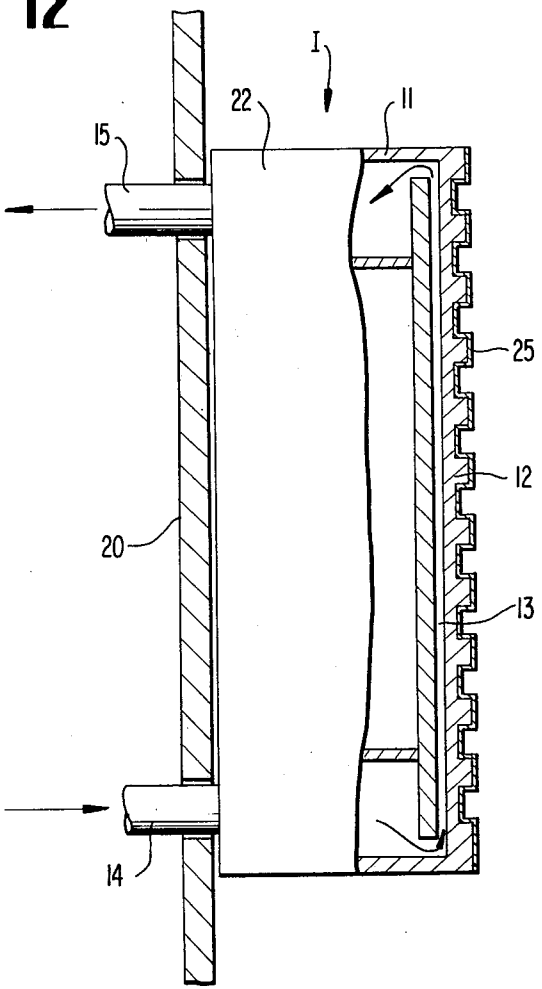
FIG. 12 is a sectional view of a further preferred embodiment of the present invention.

In FIG. 12 there is shown a further preferred embodiment of the present invention which is substantially similar in construction to those shown in FIGS. 9 and 11 except that means is provided for increasing a melting point of the heat-receiving surface of the front plate 12. More specifically with the front plate 12 made of copper or copper alloy a local meltdown of the heat-receiving surface tends to occur when it is subjected to an extremely high heat load in excess of its melting point about 1,080° C. caused by the continuous contact with slag or molten metal in large quantity. Furthermore, because of a greater thermal conductivity $\lambda$ of copper, greater thermal loss results (A high thermal conductivity is one of the features of the furnace wall structures in accordance with the present invention, but it is of course preferable to minimize the thermal loss caused by this fact). In addition, the front plate 12 is exposed within the furnace so that it tends to be damaged by the impact of materials like a falling scrap harder than copper. In order to solve these and other problems, in this embodiment the slag holding ledges 18 are eliminated, and instead the heat-receiving surface 16 of the front plate 12 is formed with alternate ledges and valleys which in turn are coated to a desired thickness with a layer 25 of a metal (for example, Ti, Zr, Cr, Mo, W and their carbonated or nitric materials), cermet (which are compounds of metal and ceramic) or ceramic having a hardness and a melting point both higher than those of copper. For this purpose, any suitable means such as plating, vapor-metal plating, metal spraying and so on may be employed. The layer 25 thus formed serves to increase the mechanical strength of the heat-receiving surface of the front plate 12 so that the latter may be prevented from being damaged even when it is struck by with solid materials harder than copper. Furthermore the melting point of the heat-receiving surface of the front plate 12 may be increased so that meltdown due to the continuous contact with molten steel in large quantity may be prevented. Moreover, the thermal resistance may be increased with the resultant decrease in thermal losses. Because of the ledges formed in the heat-receiving surface of the front plate 12, the slag and the like may be more positively and strongly adhered to and accumulated on the surface. It is to be understood that the ridges and valleys may be eliminated and instead the layer 25 may be directly formed on the flat heat-receiving surface.

The features and advantages of the furnace wall structures in accordance with the present invention may be summarized as follows:

(i) Since the cooling water may be circulated at a higher flow rate, the thermal conductivity between the cooling surface of the front plate and the cooling water may be considerably increased; that is, the heat may be rapidly dissipated from the cooling surface to the cooling water, and since the heat-receiving surface of the front plate exhibits a low thermal resistance, the temperature of the outer wall of the furnace shell may be maintained satisfactorily at low temperatures even against high heat loads in a SUHP arc furnace.

(ii) The furnace wall structures exclude refractories which are exposed within the arc furnace so that consumption may be minimized.

(iii) Because the furnace wall structures are made of copper or copper alloy, they may readily and safely dissipate heat and current applied thereto due to sparks.

(iv) The front plate has an increased thickness so that it may safely withstand against the direct contact with the combustion gases discharged from the auxiliary oxygen-fuel burners, misblown oxygen gas, slags and molten steel under the normal conditions.

(v) No cooling water leakage occurs at all.

(vi) A longer service life and a minimum thermal loss may be ensured.

(vii) Because of the provision of the pole pieces and the electromagnet and because of the exclusion of any refractories within the main body, strong forces for attracting iron-containing compounds may be provided.

(viii) Because of the rough surface or provision of ledges and valleys in the heat-receiving surface of the front plate, the deposition and accumulation of slag and the like may be much facilitated and their falling-off from the heat-receiving surface may be prevented.

(iv) Because of the coating of the heat-receiving surface of the front plate with a material having a high melting point, the melting point of the heat-receiving surface itself may be increased so that damage due to the heat load in excess of a melting point of copper may be prevented. Furthermore the thermal resistance may be increased so that the thermal loss may be minimized. In addition, the mechanical strength of the heat-receiving surface may be increased and consequently may be prevented from being damaged.

(x) Because of the above-mentioned features and advantages, a long service life of the furnace wall structures may be ensured.

Water-cooled furnace wall structures according to the present invention have been now in practical use by several companies in U.S.A., Mexico and Japan. The one used by TOKYO KOTESTU Co., LTD has been working over 5,000 heats without trouble.

What is claimed is:

1. A high-heat-load furnace wall structure for an electric arc furnace wherein a cooling water passage is provided at the rear surface of a front plate of a main body which is made of copper or copper alloy and which is exposed in the furnace, and cooling water is circulated through said cooling water passage.

2. A high-heat-load furnace wall structure as set forth in claim 1 wherein a thermal conductivity and a thickness of said front plate are so selected that said front plate may have a thermal resistance from (0.5 to 1.5) $\times 10^{-4}$ $m^2 \cdot h°$ C./Kcal.

3. A high-heat-load furnace wall structure as set forth in claim 2 wherein poles pieces each made of a magnetic material and having a sufficient area are disposed within the cooling water passage, an electromagnet is disposed outwardly of said main body, and the cooling water is made to flow at a high flow rate between said pole pieces and the rear surface of said front plate.

4. A high-heat-load furnace wall structure as set forth in claim 1 wherein the heat-receiving surface of said front plate is formed with ledges.

5. A high-heat-load furnace wall structure as set forth in claim 2 wherein the heat-receiving surface of said front plate is formed with ledges.

6. A high-heat-load furnace wall structure as set forth in claim 3 wherein the heat-receiving surface of said front plate is formed with ledges.

7. A high-heat-load furnace wall structure as set forth in claim 1 wherein the heat-receiving surface of said front plate is coated with a metal, cement or ceramic having a high melting temperature at least higher than the melting temperature of copper.

8. A high-heat-load furnace wall structure as set forth in claim 2 wherein the heat-receiving surface of said front plate is coated with a metal, cermet, or ceramic having a high melting temperature at least higher than the melting temperature of copper.

9. A high-heat-load furnace wall structure as set forth in claim 4 wherein the heat-receiving surface of said front plate is coated with a metal, cermet, or ceramic having a high melting temperature at least higher than the melting temperature of copper.

10. A high-heat-load furnace wall structure as set forth in claim 5 wherein the heat-receiving surface of said front plate is coated with a metal, cermet or ceramic having a high melting temperature at least higher than the melting temperature of copper.

* * * * *